US005152847A

United States Patent [19]

LeBeau et al.

[11] Patent Number: 5,152,847

[45] Date of Patent: Oct. 6, 1992

[54] METHOD OF DECARBURIZATION ANNEALING FERROUS METAL POWDERS WITHOUT SINTERING

[75] Inventors: Stephen E. LeBeau, Plymouth; Sydney M. Kaufman, Westland, both of Mich.

[73] Assignee: Phoenix Metals Corp., Plymouth, Mich.

[21] Appl. No.: 650,365

[22] Filed: Feb. 1, 1991

[51] Int. Cl.[5] ..... B22F 1/00; C21D 6/00

[52] U.S. Cl. ..... 148/513; 148/629; 419/57; 419/58

[58] Field of Search ..... 148/16, 16.5, 20.3; 419/57, 58

[56] References Cited

U.S. PATENT DOCUMENTS

| | | | |
|---|---|---|---|
| 3,925,109 | 12/1975 | Nilsen | 148/16.5 |
| 4,011,077 | 3/1977 | Kaufman | 75/200 |
| 4,090,874 | 5/1978 | Kaufman | 75/246 |
| 4,106,931 | 8/1978 | Nayar | 148/16 |
| 4,129,443 | 12/1978 | Kaufman | 75/200 |
| 4,497,671 | 2/1985 | Wasserman et al. | 148/20.3 |
| 4,614,638 | 9/1986 | Kuroishi et al. | 419/58 |
| 4,992,233 | 2/1991 | Swaroop et al. | 419/58 |

OTHER PUBLICATIONS

Nayar in Metals Handbook, vol. 7, ASM, 1984, pp. 339–350, and p. 361.

*Primary Examiner*—Upendra Roy

*Attorney, Agent, or Firm*—Weintraub, DuRoss & Brady

[57] ABSTRACT

A method and apparatus 10 are disclosed for annealing metal powder so at to decrease the carbon content of the powder while also reducing the oxygen content thereof.

21 Claims, 3 Drawing Sheets

METHOD OF DECARBURIZATION ANNEALING FERROUS METAL POWDERS WITHOUT SINTERING

FIELD OF THE INVENTION

This invention generally relates to a method and to an apparatus for the annealing and, more particularly, to a method and an apparatus for annealing metal powder effective to reduce the carbon and the oxygen content of the powder.

DISCUSSION

Steel or metal powder is used in the formation of many types or articles of manufacture. The steel powder is subjected to a variety of processes in order to convert the powder into an article such as a gear. These articles each have a measurable hardness, ductility, tensile strength, and a variety of other physical characteristics that allow the created articles to be acceptable for a given application. The physical characteristics of the articles are determined in large part by the characteristics of the steel powder used to produce them.

That is, the steel or metallic powder which is used in the production of these articles has a direct impact upon the quality of the produced article. More specifically, the physical characteristics of the article are usually determined by the cleanliness of the powder which, in turn, is related to the powder's overall oxygen content. Generally, for many high performance applications a metal or steel powder is required which has a relatively low oxygen content in order to produce an article having a high degree of strength.

SUMMARY OF THE INVENTION

It is therefore a primary object of this invention to provide a method and an apparatus for annealing metal powder effective to reduce the oxygen content of the powder and to further decrease the carbon content thereof.

The apparatus and methodology of this invention further utilizes an annealing furnace which is operated in a manner such that most of the annealing process occurs above the characteristic oxidation curve of steel. The annealing process is further defined such that the final process, within the annealing furnace, occurs for a relatively short period of time and is operated below the characteristic steel oxidation curve. These characteristic curves being defined by both the temperatures at which the metal powder is subjected to and by the Dew Point of the various atmospheres within the furnaces. In one embodiment of the invention, the utilized atmospheres all comprise a mixture of hydrogen, water vapor, and nitrogen.

According to one aspect of this invention, a method of decarburizing metal is provided including the steps of (a) placing the metal in a first atmosphere having a first dew point;

(b) partially decarburizing the metal by heating the metal to a first temperature for a first predetermined period of time such that the rate of decarburization of the metal is substantially greater than the rate of oxidation of the metal;

(c) placing the metal into a second atmosphere having a second and substantially lower dew point associated therewith;

(d) partially decarburizing the metal by heating the metal to a second and higher temperature for a second predetermined period of time, the second temperature being slightly greater than the temperature at which said metal will reduce;

(e) placing the metal into a third atmosphere having a third dew point substantially less than the second dew point; and (f) heating the metal to a third temperature which is substantially higher than said second temperature for a third predetermined period of time whereby the oxides of the metal are reduced and this oxide reduction is effective to remove any residual carbon remaining within said metal.

Further objects, features and advantages of the invention will become apparent from the consideration of the following description and from the appended claims when taken in connection with the accompanying drawings.

BRIEF DESCRIPTION OF THE DRAWINGS

Various advantages of the present invention will become apparent to those skilled in the art by reading the following specification and by reference to the following drawings in which.

DETAILED DESCRIPTION OF THE INVENTION

Figure 1:
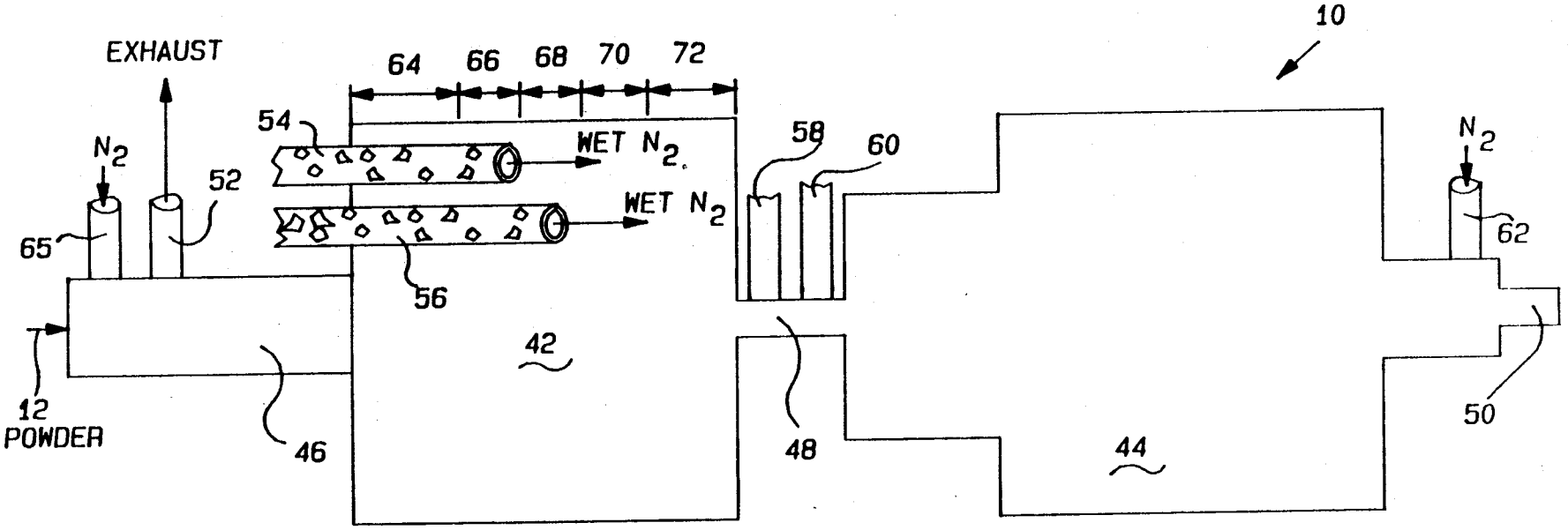
FIG. 1 is a block diagram of the annealing apparatus made in accordance with the teachings of the preferred embodiment of this invention.

Referring now to FIG. 1, there is shown the annealing methodology and apparatus (i.e. "the system") 10 of the preferred embodiment of this invention which effectively removes carbon from ground steel or metal powder 12 and which further reduces oxidation which may have occurred during the prior grinding or comminuting of the metal or steel. Before describing the operation of system 10 a further explanation of the objects and processes of the invention are needed.

According the teachings of the preferred embodiment of this invention, the decarburization and annealing of the input powder occurs without substantial simultaneous oxidation of the component metallic elements of powder. That is, steel or metallic powder has previously been difficult to process at elevated temperatures because of its tendency to form stable oxides on the particle surfaces, thereby rendering the powder essentially useless for the later manufacture of pressed and/or sintered articles. In order to alleviate these difficulties, the preferred embodiment of this invention utilizes a number of different types of atmospheres in the annealing process in order to control the timing and the rate of decarburization and oxidation. Accordingly, the atmospheres and the zones used within the system 10 are very critical to the decarburization and the relative deoxidation of the input powder and this will now be explained.

Specifically, two of the objectives of powder annealing procedures, used in iron powder manufacture, are the lowering of carbon concentration levels to below a level of approximately 0.01 to about 0.03 weight percent, preferably to a level below approximately 0.01 to about 0.02 weight percent, and most preferably to below approximately 0.02 weight percent (denoted as decarburization) and the concominant reduction of oxides formed by the previously occurring comminution or atomization processes. Steel powder, due to the fact that it typically contains silicon and manganese concentrations which are significantly higher than that of the iron powder compositions normally processed into powder, has not been commercially acceptable because of the problem of the concominant oxide formation during the decarburization of the steel powder. By discovering the properties of the oxides formed on the steel powders during such a decarburization process, a simultaneous oxidation may be avoided by a proper design of atmosphere compositions and thermal cycles according to the teachings of the preferred embodiment of this invention.

Powder annealing routinely employs mixtures of hydrogen and nitrogen gases with varying moisture concentration to effect decarburization. Water vapor is the active component in these atmospheres. Specifically, the general decarburization reaction may be denoted as follows:

$$C + H_2O_{(g)} \rightarrow CO_{(g)} + H_{2(g)}$$

The extent to which the aforementioned chemical equation or process proceeds to the right is dependent upon several factors. That is, if carbon monoxide, denoted as "CO", is continuously removed, the reaction will continue until no carbon remains in the system. If some residual carbon monoxide partial pressure exists then the extent of the reaction, as denoted above, is controlled by the hydrogen-to-water vapor partial pressure ratio. Finally, temperature is also a consideration both in the driving force for the aforementioned chemical reaction as well as for the rate of diffusion of carbon through the solid particles. This diffused carbon will move to the surface for reaction with the gas phase.

Secondly, the chemical reaction, as noted above, implies that the rates of decarburization can be increased with high water vapor concentrations. The only constraint is the possibility of simultaneous oxidation of other elements present in steel. For instance, even iron can oxidize in the presence of sufficiently high water vapor concentrations. The goal of the atmospheric control mechanism, in the preferred embodiment of this invention, is thus to selectively oxidize only the carbon and at the maximum rate possible. Specifically, enough oxygen must be present to permit decarburization at a relatively fast rate in order to make the process in the preferred embodiment, relatively efficient, but not enough so as to cause the steel to oxidize.

Figure 2:
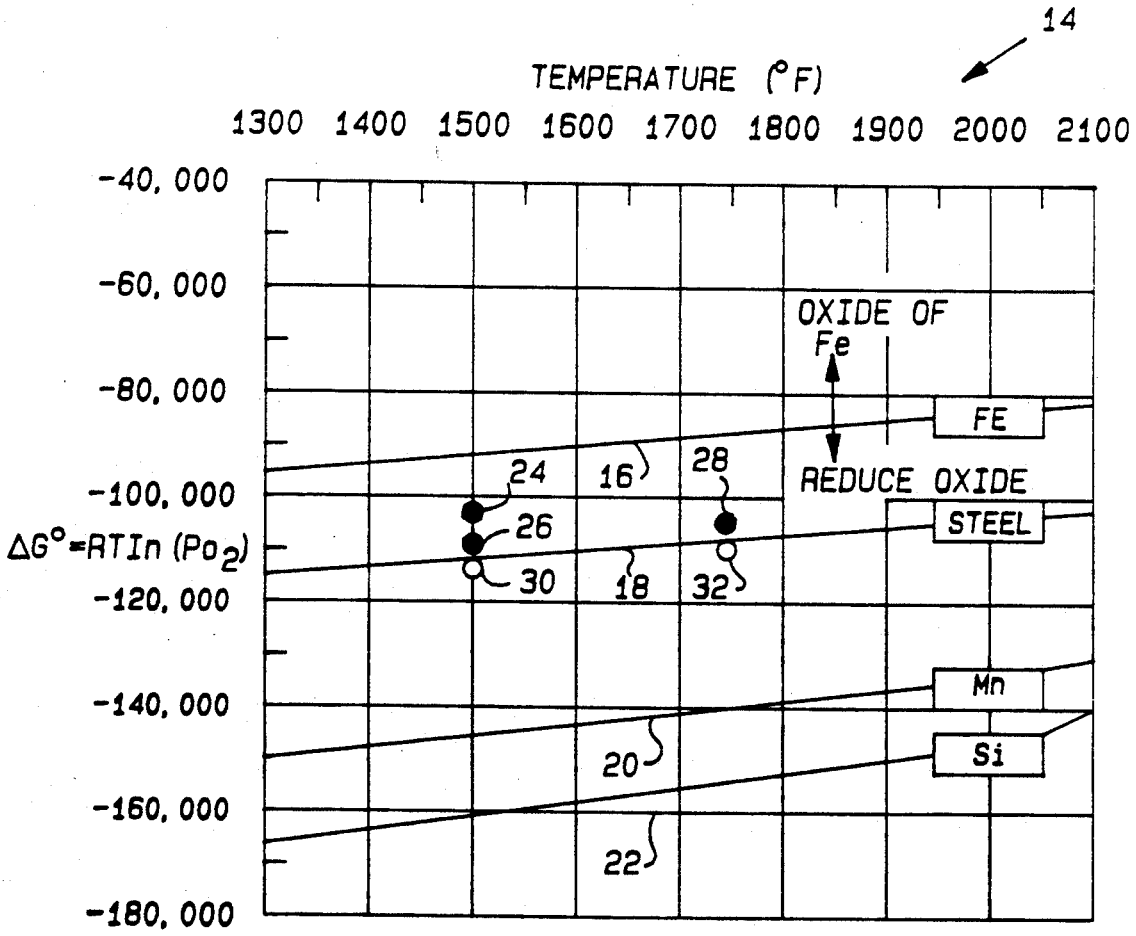
FIG. 2 is a curve showing the relationship between temperature and the free energy of iron, steel, manganese, and silicon.

The conventional method for representing the susceptibility of elements to oxidation as a function of temperature is by use of a Richardson Diagram, as shown in FIG. 2. For the general oxidation reaction the following relationships exist and are shown below:

$$\frac{X}{Y}(Me) + O_{2(g)} = \frac{1}{Y} Me_xO_{2y}$$

That is, if both the metal, denoted as "Me" and the oxide are present in their pure or standard state, the standard free energy of the reaction, denoted as "$\Delta G^o$," can be written as follows:

$$\Delta G^o = RT\ln(p_{o2}) \text{ where}$$

R is the Universal Gas Constant, T is the absolute temperature, and $p_{o2}$ is the dissociation pressure of the oxide $Me_xO_{2y}$. The dissociation pressure "$p_{o2}$" is therefore a measure of the stability of the oxide since it is a measure of the singular oxygen partial pressure at which the pure metal can coexist with its oxide or the pressure where reduction of the oxide can begin. A Richardson diagram, therefore, plots the standard free energy of the reaction for each oxide-metal equilibrium versus temperature.

Referring now to FIG. 2, there is shown Richardson Diagram 14 having curves 16, 18, 20, and 22. Specifically, curve 16 relates the standard free energy of the aforementioned reaction relative to temperature for iron while curves 18–22 relate the same parameters for steel, manganese, and silicon, respectively.

The lower the position of an oxide's stability line or curve 16–22 becomes, as shown in FIG. 2, the more stable the oxide. It therefore can be seen that pure silicon and pure maganese from oxides which are far more stable than the iron oxide since curves 20 and 22 are far lower than curve 16. Also shown in FIG. 2, are data points 24, 26, 28, 30, and 32 which were obtained from experimentation by using a steel powder with approximately 0.6 to 0.7% by weight of manganese and about 0.1% by weight of silicon. The manganese level was about 3–4 times more than that which is nominally found in commerical iron powders and the silicon level was about ten times greater. Data points 24, 26, and 28 represent atmospheric conditions where oxidation was observed and the data points 30 and 32 represent atmospheric conditions where oxidation was not observed. If a line is therefore drawn between points 30 and 32 (parallel to the curve represented by the points 24, 26, and 28) the atmosphere requirements for annealing steel powder without oxidation can be estimated. This estimation was made and used according to the teachings of the preferred embodiment of this invention and will be explained in reference to FIG. 3. qp To compute the amount of oxygen, in the form of water vapor, which cause oxidation of any of the materials, it is only necessary to compute the proportions of hydrogen to water vapor which occur in the following reaction and which would produce the dissociation pressure of the oxide in question:

$$2H_{2(g)} + O_{2(g)} = 2H_2O_{(g)}$$

This was done for iron and steel using the data shown in FIG. 2. The atmosphere has been assumed to comprise about 75% hydrogen and about 25% nitrogen with the water vapor concentration expressed as Dew Points.

Figure 3:
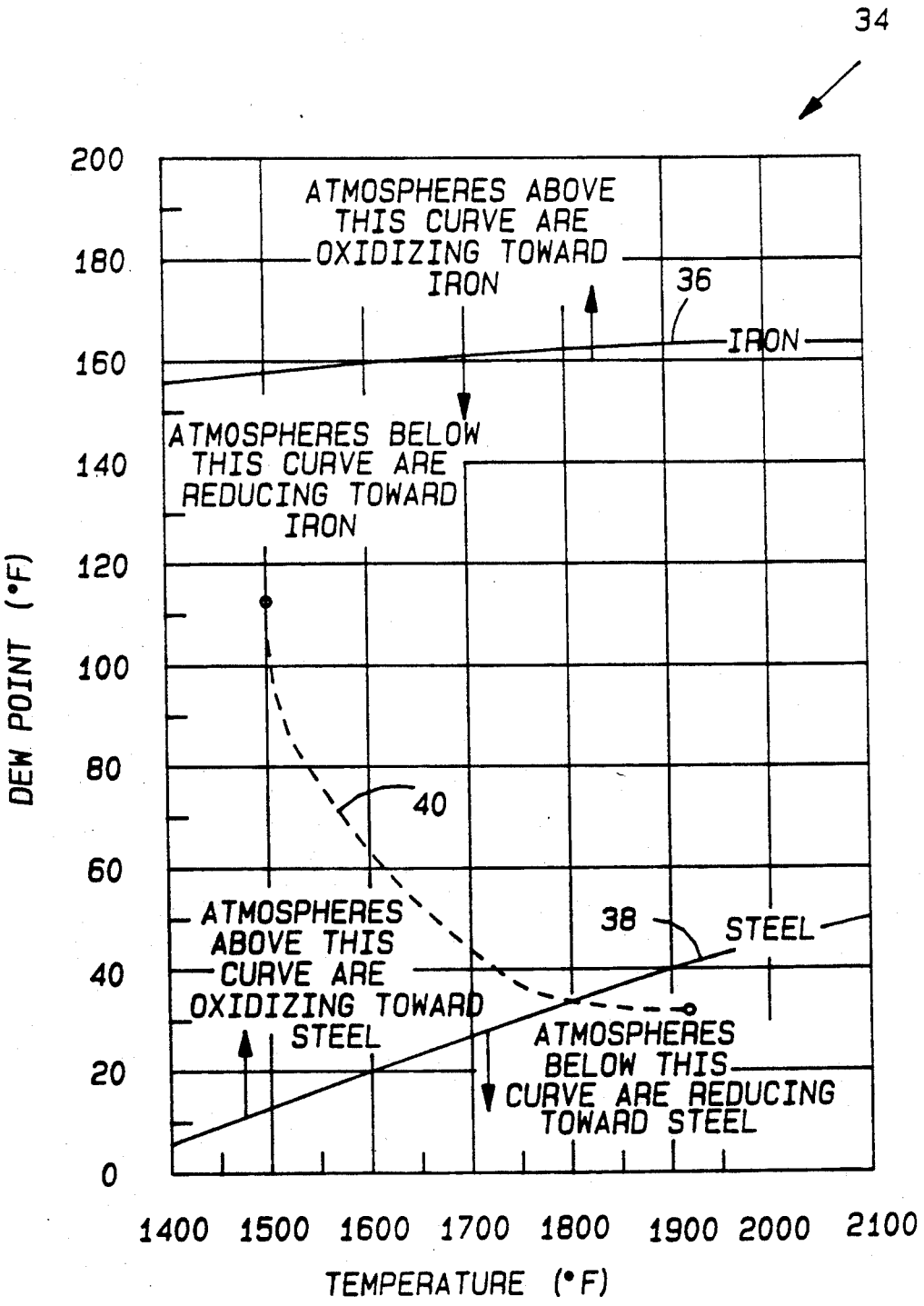
FIG. 3 is a curve illustrating various aspects of the teachings of the preferred embodiment of this invention and specifically showing the relationship between Dew Point and Temperature for both iron and steel.

Referring now to FIG. 3, there is shown a graph 34 representing a relationship between various atmospheric Dew Points and temperatures for iron and steel. Curves 36 and 38 are respectively related to iron and steel and were created by use of the estimation done in reference to the atmosphere requirements for annealing steel powder without oxidation, as discussed earlier in reference to FIG. 2. curves 36 and 38 therefore indicate the highest Dew Point that can be tolerated for each of the materials (iron and steel) as a function of temperature and without oxidation. That is, atmospheres which occur above the curve 36, as shown in FIG. 3, are oxidizing whereas atmospheres which define at Dew Points below curve 36 are reducing the iron. Similarly, atmosphere having dew points above that shown by curve 38 tend to oxidize the steel while the utilization of atmospheres having Dew Points occurring below the curve 38 tend to reduce the steel.

To compute the relative kinetics in order to compare the annealing of steel to that of iron, it was assumed that system geometries, gas flows, and atomistic mechanisms for decarburization were identical and that the starting carbon concentrations in the powders were the same. Under these assumptions, the relative kinetics should theoretically be proportional to the rate of supply of water vapor to the powder bed. In order to keep the steel from oxidizing during decarburization, water vapor concentrations during annealing must be kept to about 1% of that used for iron. Production rates of steel powder annealing must therefore be anticipated at about 1% of those attainable for iron powder if any oxidation is to be avoided. However, as seen in FIG. 3, it is possible to run the decarburization process under oxidizing conditions provided that sometime before the annealing is completed, the Dew Point of the atmosphere used is lowered to a value where the oxide will reduce. Typically, an excursion to approximately 1,900° F., keeping Dew Points well below 40° F., would substantially reduce oxygen levels in the powder bed. A possible thermal-dew point cycle for annealing is therefore indicated by the curve 40 in FIG. 3 and this cycle is used in the perferred embodiment of the invention.

That is, a first stage decarburization is initiated (according to the teachings of the preferred embodiment of this invention) at relatively low temperatures which are in the range of approximately 1300° F. to approximately 1700° F., preferably from approximately 1300° F. to approximately 1600° F., and most preferably from about 1400° F. to about 1500° F. In this temperature range, the decarburization rates are substantially higher than the oxidation rates, as long as an atmosphere having a relatively high Dew Point is used. The higher temperature range is preferred, because while the decarburization rate was observed to be most strongly related to the concentration of the oxidant in the atmosphere, the rate of oxidation remained essentialy constant. Short times with high Dew Points favored decarburization. Such initial rapid decarburization resulting in carbon levels of approximately 0.1% to about 0.3% (preferably from about 0.1% to about 0.2%) weight is possible, according to the teachings of the preferred embodiment of this invention, without increasing oxygen levels by more than 0.05% by weight (most preferably by no more than 0.02% by weight).

The second stage decarburization, according to the teachings of the preferred embodiment of this invention, involves lowering the Dew Point (i.e., introducing a new atmosphere or modifying an existing atmosphere) to a point closer to the non-oxidation value and to complete the decarburization to levels below 0.10% (preferably to below 0.05%) by weight of carbon. Finally, the Dew Point is lowered again (i.e., by changing atmospheric conditions) to about −10° F. to about −50° F., preferably from about −30° F. to about −50° F. and most preferably approximately −50° F. and the temperature is raised to the range of about 1775° F. to about 2100° F., preferably from about 1875° F. to about 2000° F. and most preferably from about 1875° F. to about 2000° F. in order to use the reduction of any residual oxides to remove residual carbon. Thus, carbon levels, according to the teachings of this invention, fall to about 0.02% by weight or less (i.e. most preferably to about 0.01% by weight) without any substantial increase in oxygen levels which were already present before annealing began.

This annealing procedure, as shown in FIGS. 2 and 3 is therefore unique in that the procedure is designed specifically for steel powder and is capable of minimizing the exposure of alloying elements to oxidation. This in effect allows retention of essentialy all alloying additions to the steel and any slight oxidation which occurs during annealing desensities the powder to oxidation during sintering without the need to apply a protective coating. It should be noted that the atmospheres utilized by this invention are comprised solely of hydrogen, nitrogen, and water vapor. Specifically, the atmospheres have approximately 75% by wieght of hydrogen and 25% by weight of nitrogen and water vapor combined.

Referring now to FIG. 1 there is shown a block diagram of the annealing and decarburization apparatus 10 of the preferred embodiment of this invention as having a furnace 42 and a cooling apparatus 44. Furnace 42 has an inlet portion 46 of approximately 8 feet and has an output air cooling portion 48 of a length of approximately 4 feet. The total length of cooling apparatus 44, according to the teachings of the preferred embodiment of this invention is approximately 29 feet including a 4 foot output portion 50. It should be realized that this aforementioned lengths may vary with production rates.

Specifically, furnace 42 has pipes 52, 54, 56, 58, and 60, deployed therein. These pipes, respectively, have diameters of 1 inch, 1 inch, 1 inch, 3 inches and 3 inches, although other diameters may be used. Additionally, pipe 65, which is coupled to a source of nitrogen, is deployed within furnace 42 in order to prevent air from entering the furnace. Exhaust products exit furnace 42 through pipe 52.

The distance that pipes 54 and 56 extend within furnace 42 is approximately 8 to 15 feet and 8 to 20 feet respectively. Both pipes 56 and 54 are coupled to a source of nitrogen while pipes 58 and 60 are respectively coupled, according to the teachings of the preferred embodiment of this invention, to a mixture of hydrogen and nitrogen gas and to nitrogen gas alone. As the powder moves through apparatus 42 (i.e. from inlet 46 to furnace 42,) pipes 54 and 56 create the desired atmospheric Dew Point conditions by simply outputting nitrogen gas containing some water vapor along their length in accordance with the illustration FIG. 3. In order to change and/or alter the Dew Point conditions (i.e., from that shown in FIG. 3) the length of the pipes 52 and 56 may be changed or the water content of the gas allowed to enter these pipes 52 and 54 can be adjusted. Cooler 44 also has a pipe 62 deployed therein which is coupled to a source of nitrogen gas in order to seal cooler 44 from air.

In order to obtain the necessary decarburization shown in FIG. 3, furnace 42, in the preferred embodiment of this invention, is segregated into five separate heating zones denoted zones 64, 66, 68, 70, and 72. Specifically, the length of these zones (in feet) is 6, 12, 6, 16, and 8 respectively (although other lengths may be used depending upon production rates). Zones 64–72 are used, respectively, for the following functions: heating, decarburization, heating, deoxidation, and deoxidation, according to the curve 40 shown in FIG. 3. Furthermore, depending upon the belt speed used within system 10, the time that an individual particle of the powder remains in a given zone is given by the following table:

TABLE 3

| Time in Zone (Minutes) Versus Belt Speed | | | |
|---|---|---|---|
| | Belt Speed | | |
| | 4"Per Minute | 8"Per Minute | 12"Per Minute |
| Zone 1 | 18 | 9 | 6 |
| Zone 2 | 36 | 18 | 12 |
| Zone 3 | 18 | 9 | 6 |
| Zone 4 | 48 | 24 | 16 |
| Zone 5 | 24 | 12 | 8 |

Therefore, by varying the speed of the belt in accordance with Table 3 above and through the use of zones 64–72 as explained herebefore, the powder may be placed within a needed atmosphere condition for a desired period of time such that needed decarburization may occur without significant oxidation for the final powder product in accordance with the graph 40 as shown in FIG. 3. Therefore, the final powder produced will have characteristics which will enable it to produce very desirable high tensile high strength tooling materials since the carbon content and the oxygen content of this powder is minimized and it should be obvious that powders comprising titanium, manganese, silicon, vanadium, colombium, and/or chromium may be utilized by system 10 in the aforementioned manner.

It is to be understood that the invention is not limited to the exact construction or method illustrated and described above, but that various changes and modifications may be made without departing from the spirit and scope of the invention as defined in the following claims.

We claim:

1. A method of decarburizing a powdered ferrous metal while substantially preventing the oxidation of the metal, said method comprising the steps of:

(a) placing said metal in a first atmosphere having a first dew point;

(b) partially decarburizing said metal by heating said metal to a first temperature between about 1300° F. and about 1600° F. for a first predetermined period of time such that the rate of decarburization of said metal is substantially greater than the rate of oxidation of said metal;

(c) placing said metal into a second atmosphere having a second and substantially lower dew point associated therewith;

(d) partially decarburizing said metal by heating said metal to a second and higher temperature for a second predetermined period of time, said second temperature being slightly greater than the temperature at which said metal will reduce;

(e) placing said metal into a third atmosphere having a third dew point substantially less than said second dew point; and (f) heating said metal to a third temperature between about 1775° F. and about 2100° F. for a third predetermined period of time whereby oxides of said metal are reduced and this oxide reduction is effective to substantially remove residual carbon remaining within said metal;

wherein sintering is substantially avoided so that the final product is a powder.

2. The method of claim 1 wherein each of said first, second and third atmospheres comprises hydrogen and nitrogen.

3. The method of claim 1 wherein each of said first, second, and third atmospheres contains approximately 75%, by weight, of hydrogen and 25%, by weight, of nitrogen.

4. The method of claim 1 wherein said metal comprises steel powder.

5. The method of claim 1 further comprising the step of defining said first predetermined time to be longer than said second predetermined time.

6. The method of claim 1 further comprising the step of defining said second predetermined time to be longer than said third predetermined time.

7. The method of claim 1 further comprising the step of defining said first temperature to be between 1300° F. and 1500° F.

8. The method of claim 1 further comprising the step of defining said third temperature to be between 1875° F. and 2000° F.

9. The method of claim 1, wherein said metal comprises: manganese.

10. The method of claim 1, wherein said metal comprises: chromium.

11. The method of claim 1, wherein said metal comprises: vanadium.

12. The method of claim 1, wherein said metal comprises: silicon.

13. The method of claim 1, wherein said metal comprises: colombium.

14. The method of claim 1, wherein said metal comprises: titanium.

15. The method of claim 1 further comprising the step of defining said third dew point to be approximately −50° F.

16. A method of decarburizing powdered ferrous metal while substantially preventing the oxidation of the metal, said method comprising the steps of:

(a) placing said metal in a first atmosphere having a first dew point;

(b) partially decarburizing said metal by heating said metal to a first temperature from about 1300° F. to about 1600° F. for a first predetermined period of time such that the rate of decarburization of said metal is substantially greater than the rate of oxidation of said metal;

(c) placing said metal into a second atmosphere having a second dew point substantially less than said first dew point; and (d) heating said metal to a second temperature between about 1775° F. and about 2100° F. for a second predetermined period of time whereby the oxides of said metal are reduced and this oxide reduction is effective to substantially remove residual carbon remaining within said metal;

wherein sintering is substantially avoided so that the final product is a powder.

17. The method of claim 16 further comprising the step of defining said second temperature to be between 1875° F. and 2000° F.

18. The method of claim 16 further comprising the step of defining said second point to be approximately −50° F.

19. A method for decarburizing powdered ferrous metal having certain amount of manganese therein while substantially preventing the oxidation of the metal, said method comprising the steps of:

(a) placing said metal in a first atmosphere having a first dew point;

(b) partially decarburizing said metal by heating said metal to a first temperature between about 1300° F. and about 1600° F. for a first predetermined period of time such that the rate of decarburization of said metal is substantially greater than the rate of oxidation of said metal;

(c) placing said metal into a second atmosphere having a second and substantially lower dew point associated therewith;

(d) partially decarburizing said metal by heating said metal to a second and higher temperature for a second predetermined period of time, said second temperature being slightly greater than the temperature at which said metal will reduce;

(e) placing said metal into a third atmosphere having a third dew point substantially less than the second dew point; and (f) heating said metal to a third temperature between about 1775° F. and about 2100° F. for a third predetermined period of time whereby the oxides of said metal are reduced and this oxide reduction is effective to substantially remove residual carbon remaining within said metal;

wherein sintering is substantially avoided so that the final product is a powder.

20. The method of claim 19 further comprising the step of defining said third temperature to be between 1875° F. and 2000° F.

21. The method of claim 19 further comprising the step of defining said third dew point to be approximately −50° F.

* * * * *